United States Patent [19]

Riedmueller et al.

[11] 3,937,203

[45] Feb. 10, 1976

[54] SPRING TYPE CLAY PIGEON PROJECTING DEVICE

[75] Inventors: Eberhard Riedmueller, Blaubeuren; Horst Klawitter, Sontheim, both of Germany

[73] Assignee: Ernst K. Spieth, Sontheim, Germany

[22] Filed: Dec. 26, 1973

[21] Appl. No.: 428,307

[30] Foreign Application Priority Data

Sept. 4, 1973 Germany ..... 2344483

[52] U.S. Cl. ..... 124/8; 124/47; 124/43

[51] Int. Cl.[2] ..... F41B 3/04

[58] Field of Search ..... 124/8, 9, 7, 6, 43, 42, 124/50, 49, 47

[56] References Cited

UNITED STATES PATENTS

| | | | |
|---|---|---|---|
| 2,711,726 | 6/1955 | Darrell | 124/43 X |
| 2,934,056 | 4/1960 | Lauterbach | 124/43 X |
| 2,996,058 | 8/1961 | Ervine | 124/8 |
| 3,225,754 | 12/1965 | Foster | 124/9 |

*Primary Examiner*—Richard C. Pinkham
*Assistant Examiner*—William R. Browne
*Attorney, Agent, or Firm*—Pollock, Vande Sande & Priddy

[57] ABSTRACT

The invention relates to a trap for clay pigeons, and in particular mechanism for releasing the lowermost clay pigeon of the stack contained in a magazine chamber while holding the rest of the stack in position. A pair of gripping tongs is provided for each magazine chamber, but only a single common actuating mechanism for the various tongs is used, and a single retaining device serves all of the magazine chambers in turn. The invention also provides a spring biased pivoted rod that assures correct positioning of the clay pigeons on the throwing arm.

3 Claims, 11 Drawing Figures

SPRING TYPE CLAY PIGEON PROJECTING DEVICE

BACKGROUND OF THE INVENTION

In connection with traps for clay pigeons, the problem exists that the magazine holding such pigeons will be loaded unevenly whenever some of the magazine chambers have been emptied while other magazine chambers are still completely filled. Furthermore, rotation of the magazine normally requires additional driving means.

SUMMARY OF THE INVENTION

The present invention provides a trap for clay pigeons which, despite its simple construction accomplishes at all times a uniform emptying and relief of the magazine.

According to the invention, this result is achieved by a stepped drive for rotation of the magazine driven by the driving motor at every cocking step.

In the case of the trap for clay pigeons according to the invention a single driving motor actuates all functions of the machine, i.e., both the tensioning of the hurling plate and the turning of the magazine. Moreover, since the magazine is rotated at each cocking step, i.e., after each hurling action, the clay pigeons are taken by turns from different magazine chambers, so that the magazine is emptied evenly and is always loaded evenly. This contributes substantially to the avoidance of breakdowns in the operation.

According to an advantageous further feature, the trap for clay pigeons according to the invention comprises a resilient contact member, which is disposed above the hurling plate being in a tensioned position in such a way, that it will seek to press the clay pigeon placed on the hurling plate against stop elements determining the position of such clay pigeon, and a mechanism which holds the contact member out of the area of support for the clay pigeon during triggering of the releasing mechanism. This assures that every clay pigeon placed onto the hurling plate assumes the same position, so that all clay pigeons are hurled under the same starting conditions.

A further feature of the trap for clay pigeons according to the invention consists of a holding device for every magazine chamber acting on the lowest clay pigeon in the stack, of a fixed triggering device attached in such a way that it acts upon the holding arrangement of the magazine chamber being in charging position, and of a fixed retaining device disposed in such a way that it acts on the clay pigeon which is second from the bottom in the stack in the magazine chamber which is in charge position.

Preferably the trap for clay pigeons also contains a curve controlled friction brake for damping the overswings of the hurling plate after the hurling action, thereby avoiding undesirable thrusts and cushionings.

BRIEF DESCRIPTION OF THE DRAWINGS

An embodiment of the invention is shown in the drawing by way of example.

Figure 1:
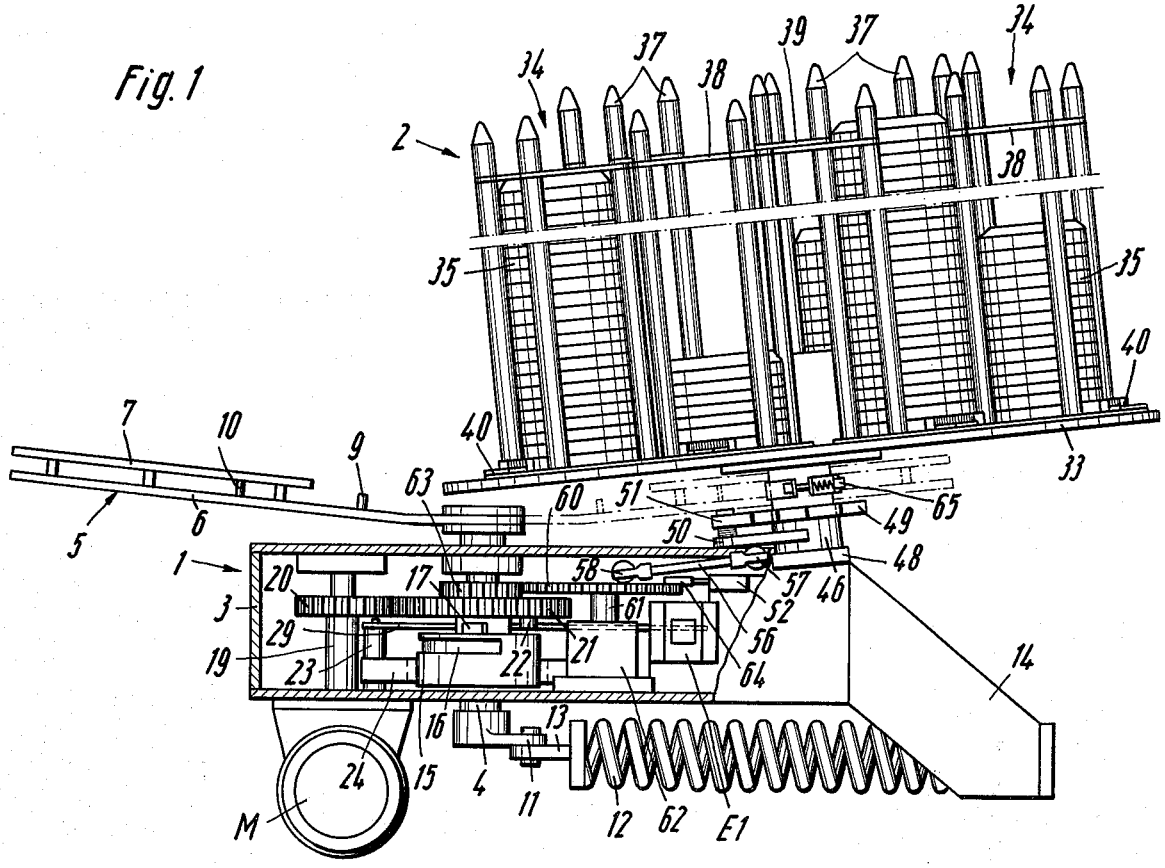
FIG. 1 shows a partially cut side view of a trap for clay pigeons, according to the invention.

The automatic trap for clay pigeons shown in the drawing consists of two main parts, namely, a lower part 1 of the machine, which represents the actual trap for clay pigeons with a cocking and hurling arrangment, and a rotatable, round magazine 2 arranged above this lower part 1 of the machine, with arrangements for the reception of a fairly large number of clay pigeons and for the automatic placement each time of these clay pigeons on the cocked hurling plate.

The lower part 1 of the machine has a box-shaped frame 3 which is mounted in the customary manner on a support, not shown, which may be adjustable for up-and-down as well as lateral movement, so that the direction of the throw can be adjusted. In the box-shaped frame 3, a shaft 4 for the hurling plate is rotatably mounted. A hurling plate 5 is attached at the upper end of the shaft 4, which plate consists in the customary manner of a support plate 6 and an uncoiling strip 7 attached along one of the edges of the supporting plate. At a wider portion or plate 6, intended for the support of the clay pigeon, a support plate 8 made of rubber is embedded into the top side of the support plate 6. Furthermore, the supporting plate 6 on its top side has a contact peg 9, which determines the precise position of the clay pigeon placed on plate 6. In the space between support plate 6 and uncoiling strip 7, there is disposed at a certain place a guide peg 10, the purpose of which will be explained later on.

On the end of the hurling plate shaft 4 projecting upwardly from the box-shaped frame 3, a crank arm 11 is attached, to which one end of a hurling spring 12 is attached by way of a pull rod 13. The other end of the hurling spring 12 is anchored to an attachment 14 of the frame 3.

Inside the box-shaped frame 3, a brake drum 15 is provided, which is fixedly connected for rotation with hurling plate shaft 4. In the upper part of this brake drum 15 a guide curve 16 is formed extending over a part of its periphery. On the upper front side, said brake drum 15 carries an upwardly projecting stop 17, and a cam 18, which serves for the operation of a terminal switch S1 (FIG. 4), is attached at a point of the periphery of the brake drum.

A geared rotor M is attached below the box-shaped frame 3. The drive shaft 19 of the gear mechanism of motor M is guided vertically upwardly through the frame 3 and carries a driving pinion 20, which meshes with a gear 21, which is mounted for free rotation on the shaft 4. The gear 21 on its bottom side carries a driver peg 22 projecting downwardly in the path of movement of which lies stop 17 of brake drum 15.

One end of a brake lever 24 is mounted swingably on vertical axle 23 attached fixedly to the floor of the box-shaped frame 3 beside the brake drum 15, which lever has a middle portion which is bent in the manner of a brake shoe fitting against the brake drum 15. For the operation of the brake lever, a brake operating lever 25 is provided, which is mounted swingably about an axle 26 and which carries at one end a guide roll 27 which runs in the guide curve 16 of the brake drum 15. The other end of the brake operating lever 25 acts by way of a compression spring 28 on the free end of the brake lever 24.

At the upper end of the axle 23 one end of a triggering lever 29 is swingably mounted, which is provided with a stop shoulder 30, which can engage the stop 17 of the brake drum 15. The triggering lever 29 is pulled to the brake drum 15 by a tension spring 31; the free end of the triggering lever 29 abuts against the armature 32 of an impact (flash) magnet E1.

The round magazine 2 has a circular plate 33, which in the case of the example shown has eight magazine chambers 34, each of which can hold a stack of clay pigeons 35. At the location of each magazine chamber 34, a hole 36 is provided in plate 33, the diameter of each such hole being somewhat larger than the diameter of a clay pigeon. Each magazine chamber is formed by four retaining bars 37, disposed in a square about the respective hole 36 and connected at their upper ends by a holding ring 38. The holding rings 38 of the eight magazine chambers are connected by connecting bridges 39, so that the entire magazine has a rigid structure.

A cocking tongs 40, provided for each magazine chamber 34, normally prevents the stack of clay pigeons from dropping through hole 34 and, as will be described later on in more detail, allows the lowest clay pigeon to drop down each time during opening. Every cocking tongs 40 consists of two levers 41 which are swingably mounted around a peg 42 attached to the periphery of plate 33 and which are biased toward each other by a spring 43. The facing ends of the levers 41 each carry a roller 44. A support 45 is attached to the central portion of each lever 41, which in its rest position projects so far inwardly beyond the associated hole 36, that the lowest clay pigeon of the stack of clay pigeons rests on it.

On lower side of the plate 33 a hollow shaft 46 is attached, which is rotatably mounted on a fixed axle 47 which extends upwardly from a lateral arm 48 of the box-like frame 3. Axle 47 is inclined somewhat toward the vertical, so that plate 33 of the magazine lies parallel to the hurling plate 5 whenever said plate is placed in cocked position below the magazine 2, as indicated in dash dot lines in FIGS. 1 and 2.

A ratchet wheel 49 is connected for common rotation on the hollow shaft 46, and a swivel plate 50 is mounted freely rotatably on the hollow shaft 46 below ratchet wheel 49. The swivel plate carries a pawl 51 cooperating with ratchet wheel 49. Furthermore a pressure bar 52 is mounted by means of an axle 53 on the swivel plate 50. A helical spring 54, the forked ends of which encircle a peg 55 attached to swivel plate 50, tends to hold the pressure bar 52 resiliently in a fixed position. The deflection of the swivel plate 50 is accomplished by means of a thrust rod 56, which is articulated on the one hand to a crank pin 57 on the swivel plate 50 and on the other hand to a crank pin 58 of a gear 60. The axle 61 of the gear 60 is mounted in a bearing 62 in the box-shaped frame 3, and gear 60 meshes with pinion 63, fixedly connected with the gear 21. A cam 64 is attached to the gear 60, which cam cooperates with an additional terminal switch S2.

A friction brake 65 acts on the hollow shaft 46, which brake is constituted by two brake levers 66, swingably mounted on a peg 67 borne by the arm 48 and whose free ends are compressed by means of a spring 68, the pretensioning of which is adjustable by means of a screw 69.

A housing 70 is fixedly attached on the inside of the magazine 2, above the plate 33 at the upper end of the fixed axle 47 passing through the center aperture of the plate 33, in which housing an additional flash magnet E2 is housed. The armature 71 of the flash magnet E2 is connected with an operating wedge 73 by way of a push rod 72, which wedge being shiftably mounted in a recess 74 of the housing base plate 75 and normally being held in its pull-back position by springs 76. The parts are aligned and arranged in such a way that the operating wedge 73 stands in front of the sliding rollers 44 of the cocking tongs 40 of that magazine chamber which is brought into the charge position by rotation of the plate 33 (FIG. 2), i.e. into the position in which the magazine chamber 34 is above the support plate 8 of hurling plate 5 whenever the latter is moved into cocked position.

Figure 9:
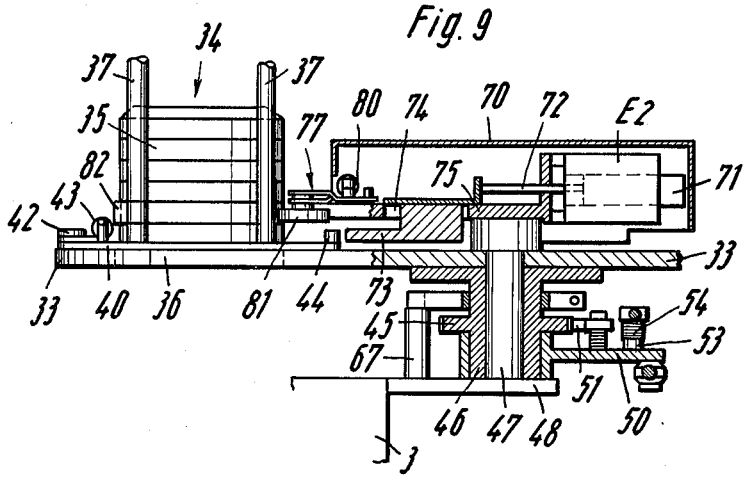
FIG. 9 is a partially sectioned view of the lower part of the magazine and of the release mechanism for the clay pigeons.
Figure 10:
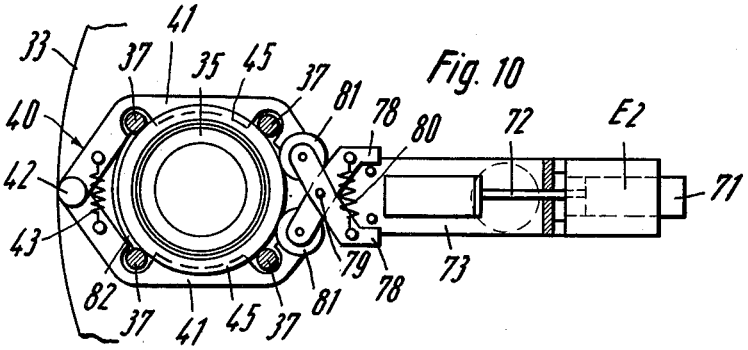
FIG. 10 is a section of the arrangement of FIG. 9 illustrating the retaining device for the clay pigeon which is second from the bottom.
Figure 11:
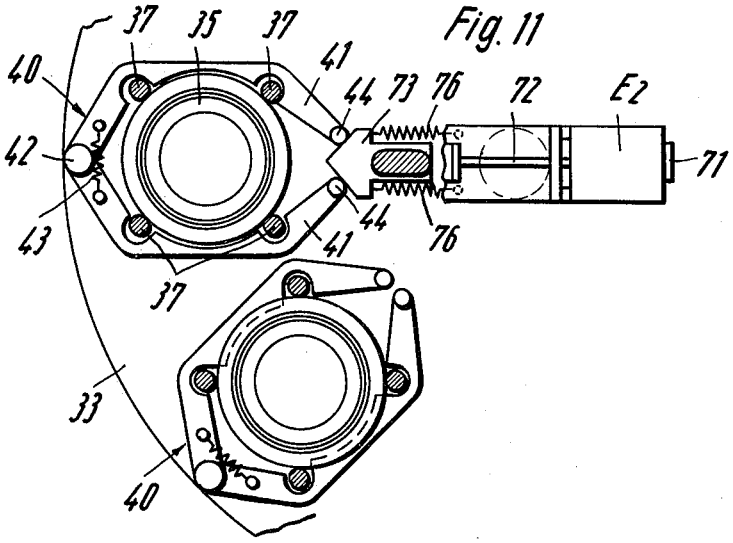
FIG. 11 is a section of the arrangement of FIG. 9 illustrating the retaining device for the lowest clay pigeon and the associated triggering mechanism.

Above the operating wedge 73, a contact mechanism 77 has been provided two levers 78, which are mounted swingably in the manner of a pair of scissors on an axle 79 borne by the base plate 75, and which are biased toward each other by a spring 80. At the front end, each lever 78 carries a rubber pressure rod 81; the two rubber pressure rods 81 are disposed in such a way (FIG. 9) that they rest at the level of the second clay pigeon from the bottom of the stack located in a magazine chamber and that they are pressed by a spring 8 against the clay pigeon which is second from the bottom of the stack, so that they press said clay pigeon against a holding bow 82 which is attached between the two outside holding bars 37 of the respective magazine chamber. Preferably the holding bow 82 is covered on its interior with a material having a high friction coefficient, e.g., rubber.

Operation

The machine just described operates in the following manner: In the rest position following a throw, shown in solid lines in FIGS. 1, 2 and 3, the hurling spring 12 is cocked the least, the crank arm 11 assumes its lower dead center position and the hurling plate 5 is turned out of the cocked position by almost 180°. The gear 60 is so positioned, that the swivel plate 50 is swung away by the push rod 56 farthest from the frame 3 and in this position the pawl 51 has just engaged behind the next tooth of ratchet wheel 49. Pressure rod 52, which is shown broken away in FIG. 3, assumes the position determined by the helical spring 54.

Figure 3:
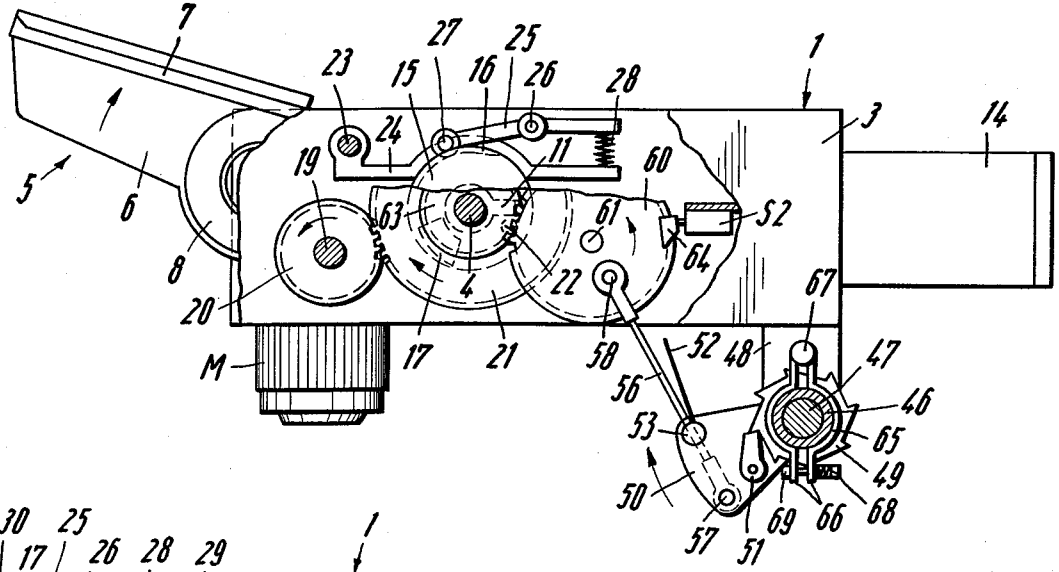
FIG. 3 is a top view partly in section of the drive and cocking mechanism in rest position of the hurling plate.

For cocking the hurling plate 5, the geared engine M is switched on in a direction of rotation such that the parts move in the direction indicated by arrows in FIG. 3. After switching on, the gear 21 at first rotates without load on the hurling plate shaft 4, whereby however it drives the gear 60 by way of pinion 63. Immediately after switching on by way of the push rod 56, gear 60 swivels swivel plate 50 clockwise, whereby the pawl 51 drives the ratchet wheel 49 and as thereby rotates magazine 2. This causes the next magazine chamber 34 to move into charge position. When the gear 21 has turned through a certain angle, the driving peg 22 abuts against the stop 17 of brake drum 15, so that in case of a further turn of gear 21, the brake drum and thus the hurling plate shaft 4 are carried along. Hurling plate 5 is thereby swiveled in a clockwise direction and crank arm 11 again cocks the hurling spring 12.

Figure 4:
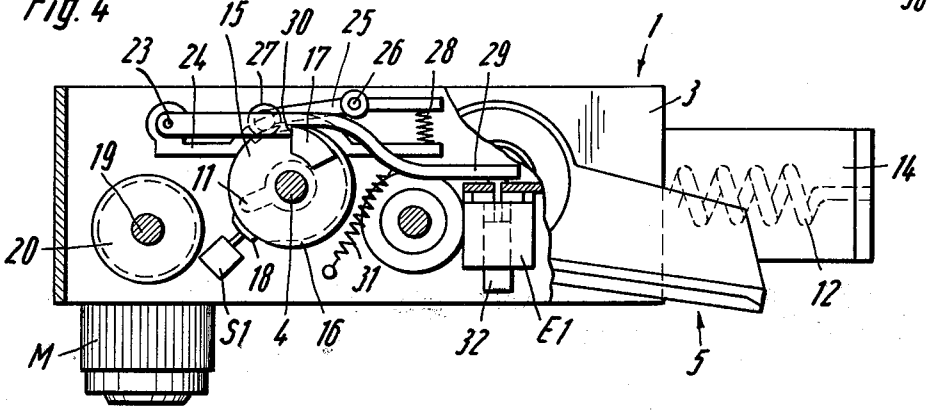
FIG. 4 is a top view partly in section of the drive and cocking mechanism of the hurling plate in cocked position.
Figure 5:
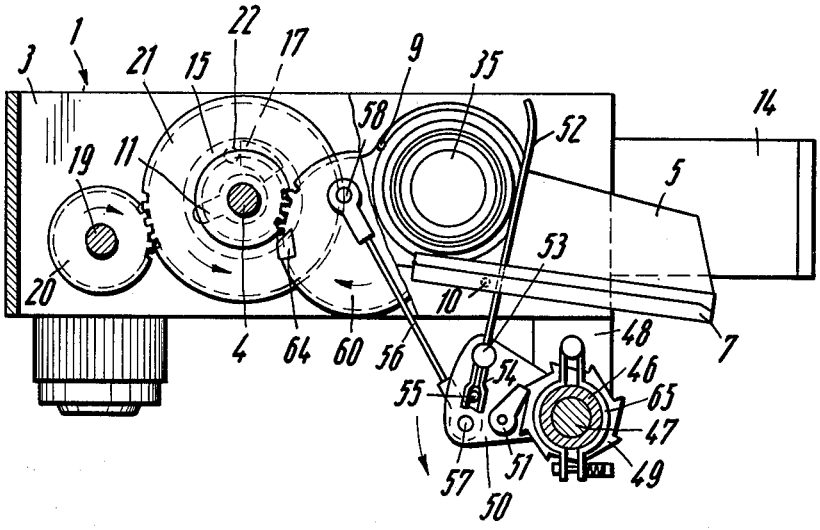
FIG. 5 is a top view similar to FIG. 3 after the clay pigeon has been placed onto the hurling plate being in the cocked position.

This turning movement is continued until the hurling plate 5 has reached the cocked position (FIG. 4). In this position the cam 18 actuates the terminal switch S1, which on the one hand interrupts the operating circuit of the geared motor M and on the other hand starts up a time relay. In this cocked position furthermore, the stop 17 of the brake drum 15 has been engaged behind the stop shoulder 30 of the triggering lever 29 (FIG. 4). The transmission ratio between the pinion 63 and the gear 60 is so dimensioned, that the gear 60 upon reaching the cocked position has turned precisely by one half turn (FIG. 5), so that the swivel plate 50 is swiveled farthest toward the frame 3. In this position the magazine 2 has been turned by a one-eighth turn by means of the ratchet wheel 49, so that the next magazine chamber 34 has been brought into charge position. During this movement, the rubber pressure rolls 81 of the pressure mechanism 77 have run up on the clay pigeon which is the second from the bottom of the stack in this magazine chamber. Furthermore, in this position of the swivel plate 50, the pressure rod 52 has been completely swiveled away from the periphery of the support plate 8, so that it does not impede the placing of a clay pigeon on this support plate (FIG. 5).

The time relay energizes the flash magnet E2 for a period of 0.5 seconds. The armature 71 of this flash magnet shifts the operating wedge 73 by way of the rod 72 between the rollers 44 of the cocking tongs 40 of the magazine chamber 34, which has been brought into charge position through rotation of the magazine. This causes the levers 41 of this cocking tongs to be forced apart, so that the supports 45 are pulled out from below the lowest clay pigeon of the stack of this magazine chamber. The lowest clay pigeon can then drop through the hole 36 down to the support plate 8 of hurling plate 5. On the other hand, the second to the lowest clay pigeon will be held firmly by being forced against the holding bow 82 by the rubber pressure rolls thereby preventing slippage of the stack of clay pigeons.

After expiration of the 0.5 second period, the flash magnet E2 is again de-energized, so that the springs 76 can pull back the operating wedge 73; the cocking tongs 40 is closed again then through the action of spring 43. Simultaneously the time relay again switches on the geared motor M with a reversed rotational direction, as indicated by the arrows in FIG. 5. The gears 21 and 60, as well as the swivel plate 50 will again be moved back to their starting positions whereby pawl 51 is again caused to engage with the next tooth of the ratchet wheel 49. The friction brake 65 prevents an unintended rotation of magazine 2.

During swivel back of the swiveling plate 50, however, pressure rod 52 cannot return to its starting position since it fits against the clay pigeon 35 meanwhile placed in onto the supporting plate 8. In the case of a further swiveling of the swivel plate 50, the pressure rod 52 therefore will be swiveled around its axis 53, causing helical spring 54 to be cocked by peg 55 and pressure rod 52 to be yieldingly against the clay pigeon. The pressure rod 52 therefore shifts the clay pigeon on the support plate 8 until it fits against abutting peg 9 and uncoiling strip 7. This measure will guarantee that all clay pigeons are brought into the same unequivocally defined position on the hurling plate, and that they are held in this position until the throw.

Figure 6:
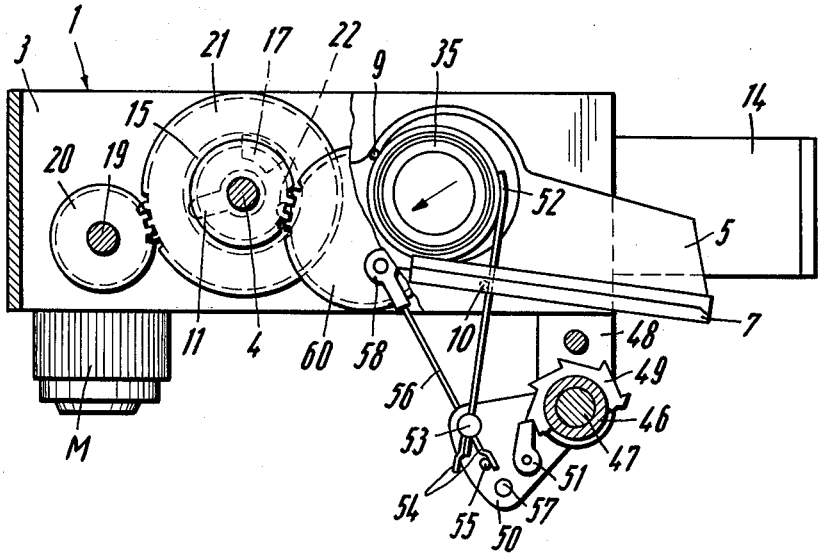
FIG. 6 is a top view of the arrangement of FIG. 5 at the end of the cocking step.

Whenever finally gears 21 and 60 again have reached their starting position (FIGS. 6 and 8), cam 64 actuates terminal switch S2, which switches off the geared motor M. Now the trap is ready to throw.

Figure 7:
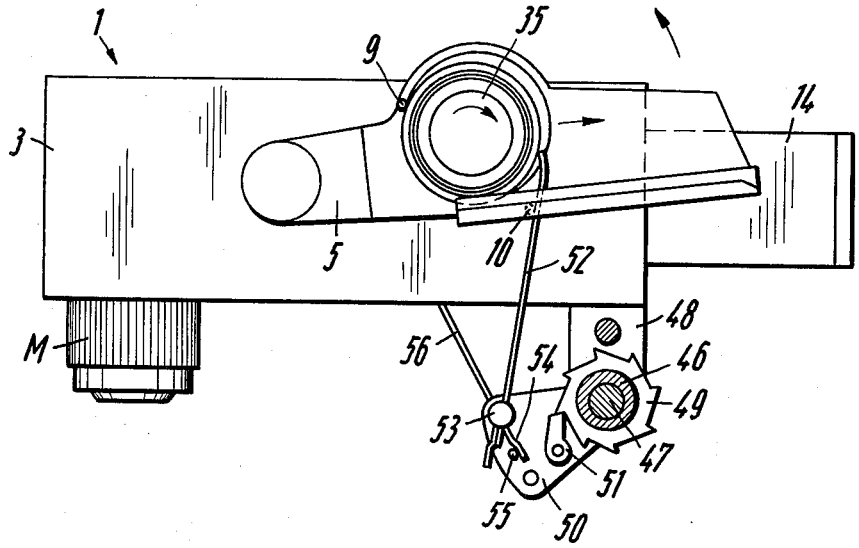
FIG. 7 is a top view of the hurling mechanism during the hurling step.

To trigger the throw, the flash magnet E1 is actuated, for example by manually closing a switch. The armature 32 of the flash magnet E1 swivels the triggering lever 29 counter to the force of tension spring 31, so that the stop shoulder 30 releases the stop 17. As a result, hurling spring 12 can turn hurling plate shaft 4 by way of the crank arm 11 and the hurling plate 5 is swiveled counterclockwise with great acceleration from the cocked position (FIG. 7). At the same time the guide peg 10 holds back the pressure rod 52 on the supporting plate 6, so that it will not impede the clay pigeon during the throw.

During further turning of the hurling plate 5, the clay pigeon rolls along outwardly uncoiling strip 7 due to centrifugal force until it is finally hurled.

Figure 8:
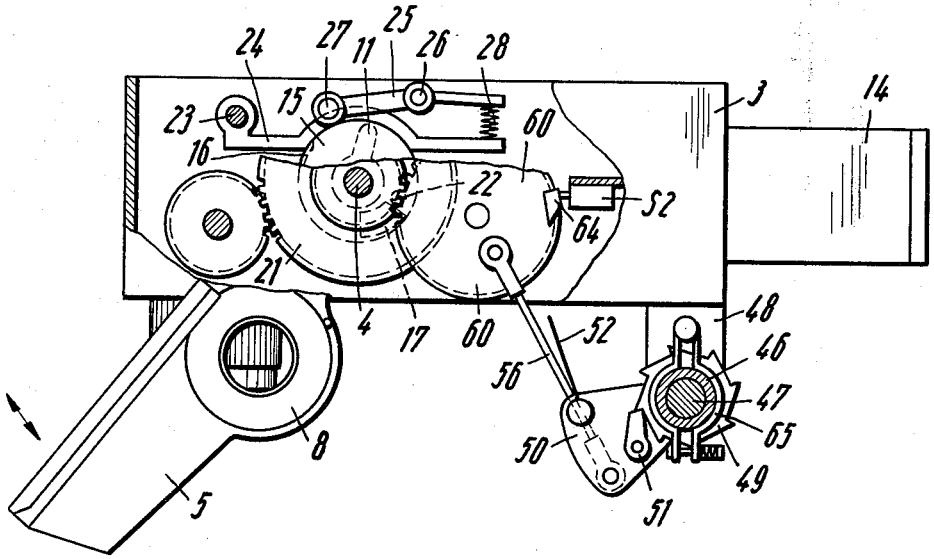
FIG. 8 is a top view partly in section similar to FIGS. 5 and 6, at the end of the hurling step.

During the further turn, hurling plate 5 tends to swing beyond its the rest position because of the kinetic energy imparted to it, the hurling spring 12 is again cocked during over-swinging, so that it decelerates the hurling plate 5 and then moves it back again to rest position (FIG. 8). The oscillations developing in this manner are dampened by the friction brake consisting of the brake drum 15 and the brake lever 24, so that excessive thrusts and cushionings will be avoided. As soon as the hurling plate 5 has passed through the rest position, the guide roll 27 of the brake actuating lever 25 runs up on an elevated section of the guide curve 16 (FIG. 8), as a result of which the brake actuating lever 25 is swiveled and presses the brake lever 24 against the brake drum 15 by way of the pression spring 28. The control of the friction brake 15, 24, by means of the guide curve 16, facilitates an effective damping of the overswing without impeding the throw because of the brake.

Figure 2:
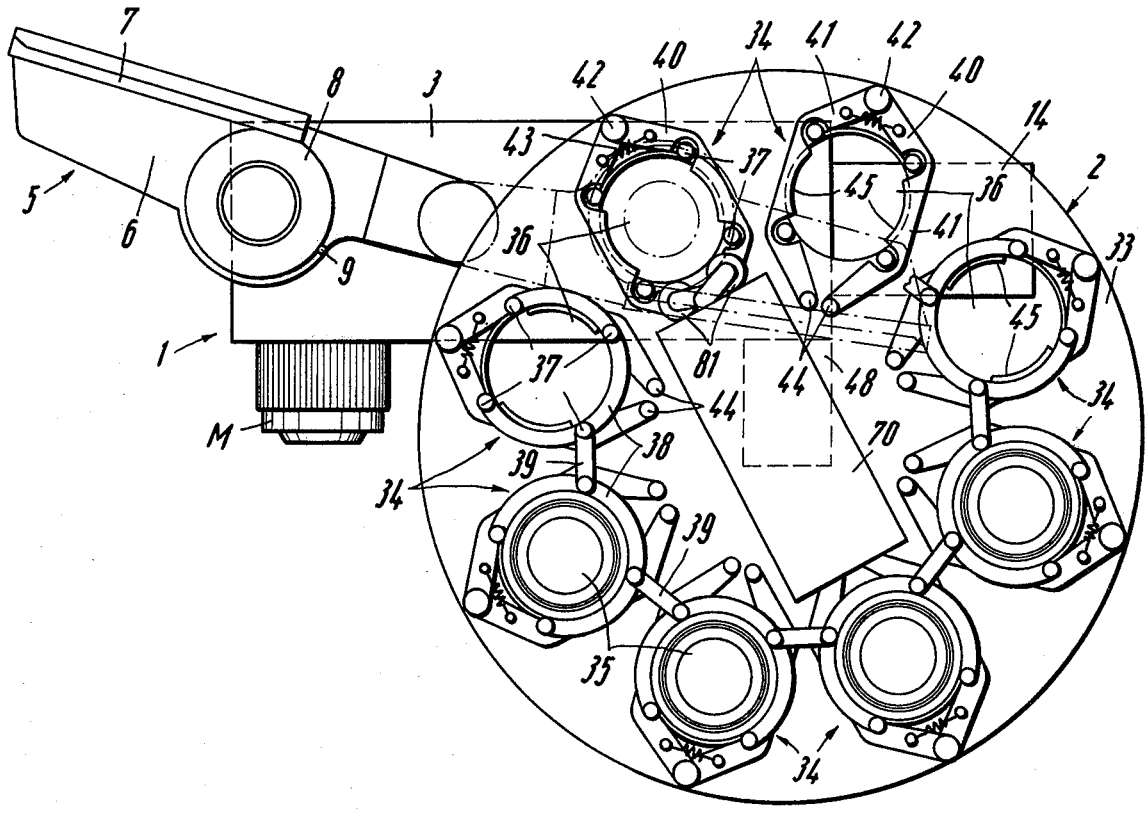
FIG. 2 is a top view of the trap for clay pigeons according to FIG. 1.

Finally, whenever all parts again assume the starting position shown in FIGS. 1, 2 and 3, the trap is ready for the next cocking position.

Whenever during the succeeding cocking step the magazine 2 is rotated by one eighth turn in the manner described above, the second lowest clay pigeon (which now has become the lowest clay pigeon) moves off the rubber pressure rolls 81 of the pressure mechanism 77. As soon as the rubber pressure rolls have released this clay pigeon, the entire stack of clay pigeons can slide down in this magazine chamber until the lowermost clay pigeon rests on the supports 45 of the pertinent cocking tongs 40.

From the previous description one can recognize that the magazine is rotated by one step after each throw, so that the clay pigeons are drawn in rotation from the respective magazine chambers. The result of this is that that magazine chambers are emptied evenly and the magazine 2 always remains in balance. Furthermore, rotation of the magazine is accomplished by the same geared motor, which accomplishes care of the cocking of the trap.

What is claimed is:

1. A trap for clay pigeons comprising a support, a shaft rotatably mounted on the support, a hurling plate attached to the shaft, a crank arm, a hurling spring having one of its ends anchored on the support and the other of its ends anchored on the crank arm attached to the shaft, means for rotating the shaft in order to move the hurling plate into cocked position while cocking the hurling spring, a triggerable stop arrangement retaining the hurling plate in cocked position, a magazine having a plurality of magazine chambers and being rotatably mounted on the support above the hurling plate, each of the magazine chambers being adapted to receive a stack of clay pigeons, means for rotating the magazine in a step-wise manner during each cocking operation so as to bring the magazine chambers successively into a charge position in which each magazine chamber is above the hurling plate in its cocked position, a pair of gripping tongs for each magazine chamber acting on a lowermost clay pigeon of the stack of clay pigeons, a fixed triggering device which acts upon the holding device of the magazine chamber when in charge position for releasing the lowest clay pigeon, the triggering device having a wedge means for moving from a nonengaging tong position to a tong-engaging position to bias the tongs to an open position so as to allow a lowermost target to drop on to the hurling plate and a fixed retaining device which engages the second lowest clay pigeon of a stack of clay pigeons when the magazine chamber is moved into charge position to retain said clay pigeon and the stack above it upon release of the lowest clay pigeon until the magazine chamber is moved away from the charge position.

2. A trap for clay pigeons according to claim 1, wherein the retaining device has resiliently mounted pressure roller means for engaging a stack of clay pigeons in the magazine chamber being moved into charge position so as to hold a stack of clay pigeons above the lowermost pigeon and prevent said stack from falling during the loading of the hurling plate with a lowermost pigeon.

3. A trap for clay pigeons comprising a support, a shaft rotatably mounted on the support, a hurling plate attached to the shaft, a crank arm a hurling spring having one of its ends anchored on the support and the other of its ends anchored on the crank arm attached to the shaft, motor-driven means for rotating the shaft in order to move the hurling plate into cocked position while cocking the hurling spring, a triggerable stop arrangement retaining the hurling plate in cocked position, a magazine having a plurality of magazine chambers and being rotatably mounted on the support above the hurling plate, each of the magazine chambers being adapted to receive a stack of clay pigeons, a ratchet wheel connected for common rotation with the magazine, a swivel plate connected to the ratchet wheel and to the motor-driven means and mounted for reciprocal rotational movement about the axis of rotation of the ratchet wheel, a pawl mounted on the swivel plate and adapted to engage the ratchet wheel, a crank mechanism interconnecting the motor-driven means and the swivel plate so that during each cocking operation the swivel plate is put in a reciprocal movement between two end positions and through the ratchet and pawl mechanism rotates the magazine in a step-wise manner so as to bring the magazine chambers successively into a charge position in which each magazine chamber is above the hurling plate in its cocked position, a triggerable mechanism for releasing the lowest clay pigeon of a stack of clay pigeons in the magazine chamber in its charge position, a pressure rod means pivotally mounted on the swivel plate and pivotably against the bias of a spring in response to movement of the swivel plate (so as to extend) to a cocked position to cause a clay pigeon placed on the hurling plate to be moved stop members on the hurling plate prior to projection, and to be out of the path of the clay pigeon dropping from the magazine chamber onto the hurling plate upon triggering of the release mechanism, and means for triggering the release mechanism in timed relation to the reciprocal movement of the swivel plate.

* * * * *

UNITED STATES PATENT AND TRADEMARK OFFICE

CERTIFICATE OF CORRECTION

PATENT NO. : 3,937,203

DATED : February 10, 1976

INVENTOR(S) : EBERHARD RIEDMUELLER ET AL.

It is certified that error appears in the above-identified patent and that said Letters Patent are hereby corrected as shown below:

In the claims:

Claim 1, line 22, change "the stack" to --a stack--.

Claim 3, line 33, change "pivotably" to --pivotable--;

line 37, insert --against-- at the beginning of the line.

Signed and Sealed this

Thirtieth Day of November 1976

[SEAL]

*Attest:*

RUTH C. MASON
*Attesting Officer*

C. MARSHALL DANN
*Commissioner of Patents and Trademarks*